United States Patent [19]

Gunther

[11] 4,003,351

[45] Jan. 18, 1977

[54] ROTARY ENGINE

[76] Inventor: William E. Gunther, 2200 High St., Apt. 868, Cuyahoga Falls, Ohio 44221

[22] Filed: June 2, 1975

[21] Appl. No.: 582,648

[52] U.S. Cl. ..... 123/44 R; 123/44 E; 92/58

[51] Int. Cl.[2] ..... F02B 57/00

[58] Field of Search ..... 123/44 E, 44 B, 44 R; 92/58; 417/462

[56] References Cited

UNITED STATES PATENTS

| | | | |
|---|---|---|---|
| 385,226 | 6/1888 | Barden | 123/44 E |
| 719,045 | 1/1903 | Rieske | 123/44 E |
| 936,036 | 10/1909 | Reimers | 123/44 E |
| 1,050,655 | 1/1913 | Homan et al. | 123/44 R |

FOREIGN PATENTS OR APPLICATIONS

| | | | |
|---|---|---|---|
| 388,145 | 5/1924 | Germany | 123/44 E |
| 53,706 | 10/1916 | Sweden | 123/44 B |
| 446,873 | 5/1936 | United Kingdom | 123/44 B |
| 7,603 | 1896 | United Kingdom | 123/44 B |

*Primary Examiner*—Wendell E. Burns
*Attorney, Agent, or Firm*—Hamilton, Renner & Kenner

[57] ABSTRACT

Disclosed is a short stroke, rapid fire, continuous power rotary engine which can be affixed to the body of a vehicle or other stationary position, depending upon its intended use. The engine includes a housing within which is a rotating block which houses the pistons and at least one cylinder. A central power shaft having first and second sections mounted within the housing is connected to the rotating block. Upon ignition, the expanding gases urge the pistons radially outwardly from the axis of the central power shaft. Further provided are piston rods and means for transmitting the radially outward movement of the pistons to the rotating block, thereby imparting a rotational moment thereto. The engine also includes a fuel intake system and novel ignition and exhaust systems.

14 Claims, 12 Drawing Figures

ROTARY ENGINE

BACKGROUND

The present invention relates to a rotary engine utilizing a housing and rotating block arrangement wherein the pistons are placed within the rotating block and accomplish rotational drive by urging drive cam followers against a segmented drive cam inner circumferential surface. More specifically, this invention relates to an engine structure which uses a short stroke at low, but constant or variable revolutions per minute to accomplish a higher efficiency than prior art forms.

A great deal of attention and research has been applied to the end of producing a powerful, efficient, light-weight, and easily accessible engine both in the past and continuing today. The advent of the first automobile, seems to have set off a lot of the increased interest in such work. Today, however, we are still faced with a rather heavy and inefficient engine for the most part and with the forecasters telling of the ever impending energy problems for the future, it becomes increasingly important to significantly improve the basic internal combustion engine which powers so much of today's society. Moreover, an engine having fewer components and a less complex operation would be highly desirable to increase efficiency with an attendant decrease in repair and service costs.

There have been numerous attempts to develop a rotary type engine for greater efficiency, fuel economy, less service and the like, but until the development of the Wankel engine these have met with little commercial success because the in-line and V-type engines with a crank shaft have virtually dominated the commercial market. A few of these prior art engines which are of interest are U.S. Pat. Nos. 1,282,824; 1,456,479; 1,475,005; 1,619,273; 1,673,968; 1,722,257; 1,800,677; 1,990,660; 3,161,183; and, 3,572,209. Although the foregoing-named patents are directed to the development of a feasible commercial version of the rotary engine, none have achieved the advantages of the present invention.

SUMMARY OF THE INVENTION

It is an object of the present invention to provide a new rotary engine that consumes less fuel to produce a given output of mechanical work in commercial utilization.

It is a further object of the present invention to provide a mechanical advantage over prior art engines for a given size and weight.

It is another object of the present invention to increase fuel economy by utilizing a shorter stroke, providing for a more frequent firing, i.e., more than once per revolution, and to provide continuous power at lower rpm without losing mechanical power.

It is a still further object of the present invention to provide an engine in which components are more easily and economically replaced when worn to obtain a longer engine life.

It is a further object of the present invention to reduce the number of moving parts.

It is yet another object of the present invention to provide an engine having novel ignition and exhaust systems.

These and other objects of the present invention, together with the advantages thereof over existing and prior art forms, which will become apparent from the description to follow, are accomplished by the improvements hereinafter described and claimed.

In general a rotary engine employing the concept of the present invention includes a housing, a central power shaft establishing an axis through said housing and having first and second sections each of which is rotatably mounted in the housing, a rotating block connected between the first and second sections, at least one cylinder within the rotating block, at least two pistons mounted in the rotating block so as to communicate with the cylinder, a piston rod connected to each piston at one end and means for transmitting the radially outward movement of said pistons to said rotating block thereby imparting a rotational movement thereto. Further included is a fuel intake system, a novel exhaust system and a novel ignition system.

The preferred embodiment of the subject rotary engine is shown by way of example in the accompanying drawings and description, without attempting to show all of the various forms and modifications within the concept of the present invention; the invention being measured by the appended claims and not by the details of the specification.

DESCRIPTION OF THE PREFERRED EMBODIMENTS

Figure 1:
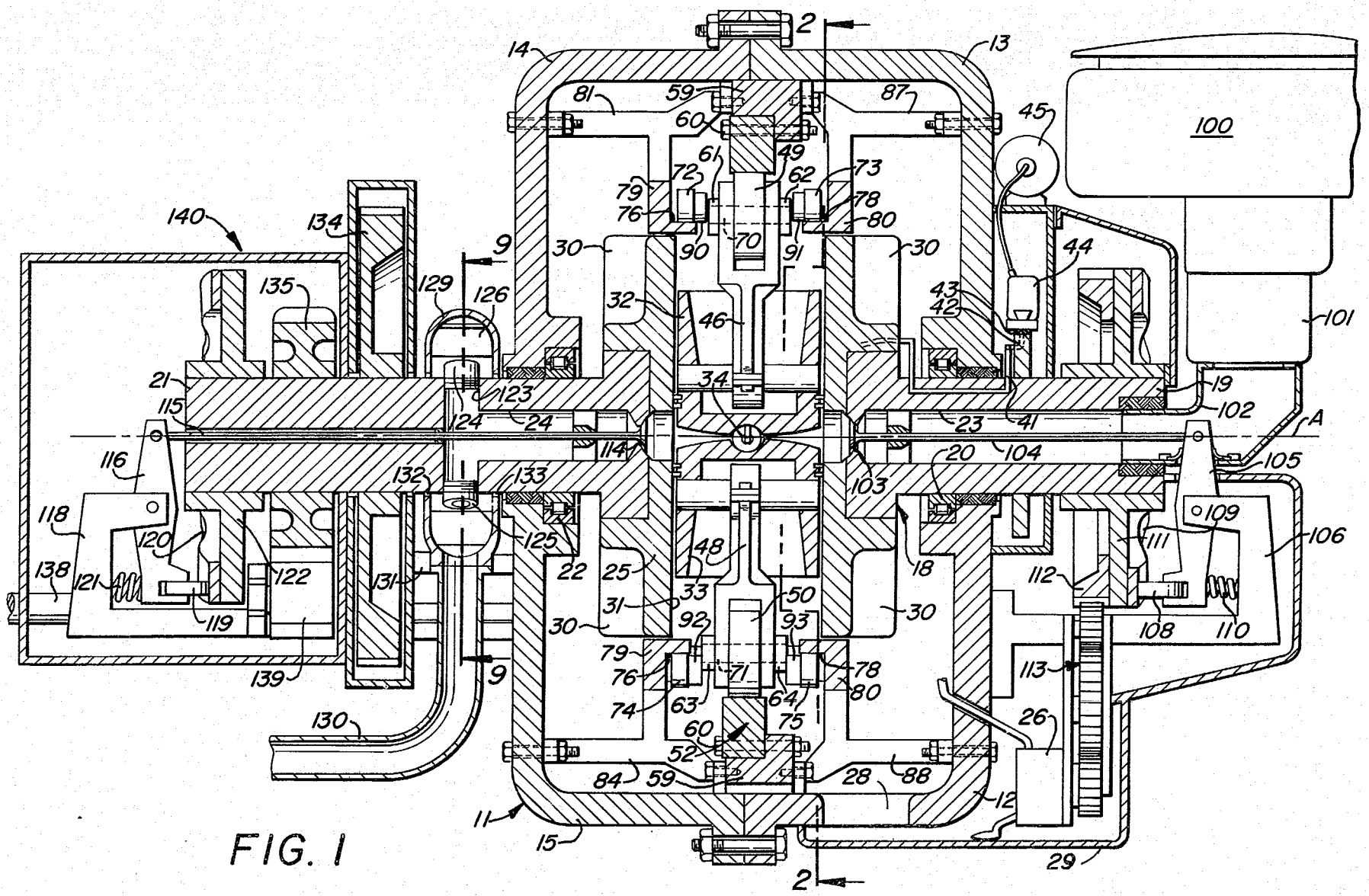
FIG. 1 is a side elevation, partially in section, of a rotary internal combustion engine embodying the concept of the present invention.
Figure 3:
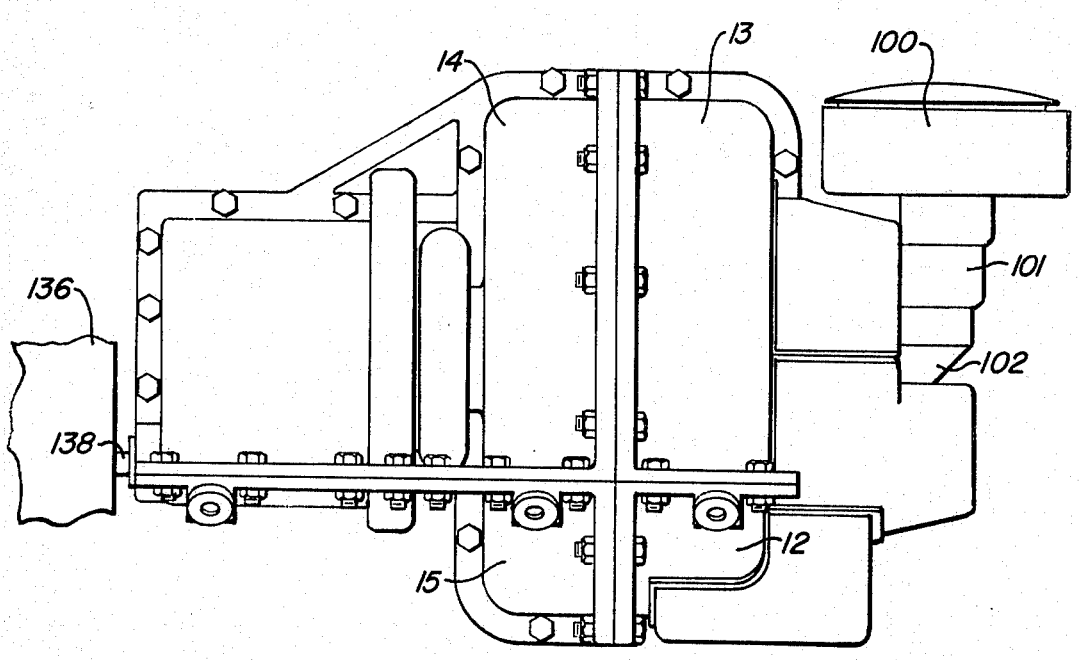
FIG. 3 is a side elevation of the exterior profile of the rotary engine embodying the concept of the present invention.

Referring to the drawings, an internal combustion embodiment of the present concepts of the rotary engine is indicated generally by the numeral 10 in FIG. 1. A block or housing, generally indicated by the numeral 11, is preferably formed from six flanged sections 12, 13, 14, 15, 16 and one not shown, behind section 16, which are bolted together or fastened in an appropriate manner to provide a sealed chamber within which the moving components of the engine reside. FIG. 3 of the drawings amply shows the segmental construction of the fixed block from the exterior. It is believed that such a segmented fixed block will provide easy access to the interior moving parts for maintenance and repair. This shoud significantly reduce costs in maintaining the subject engine since only one section need be removed to gain access to approximately one-sixth of the interior.

Rotatably mounted within housing 11 is a central power shaft generally indicated by the numeral 18 which establishes a longitudinal axis of rotation A. A first or intake section 19 of central power shaft 18 is rotatably mounted in flanged sections 12, 13 and 16 of housing 11 by a suitable bearing system 20. A second or exhaust section 21 of central power shaft 18 is rotatably mounted in flanged sections 14, 15 and the section not shown of housing 11 by a similar appropriate bearing system 22. The intake section 19 of the central power shaft 18 has a longitudinally extending bore 23, concentric with the axis A, to define a passageway therethrough to supply a fuel mixture to the engine 10. The exhaust section 21 of the central power shaft 18 also has a longitudinally extending bore 24 of a large diameter in approximately the axially inner half of section 21 to define a passageway therethrough to allow the expended gases to escape the engine 10. The bore thereafter is narrowed to accommodate valving arrangements for the exhausts.

Interconnected between intake section 19 and exhaust section 21 of the central power shaft 18, by any suitable manner, is a rotating block 25, which provides the driving force to the central power shaft 18 about the axis A established through housing 11 by central power shaft 18. This rotating block 25 thus connected to the intake section 19 and exhaust section 21 serves as part of the central power shaft 18 to provide a special economy by eliminating many moving parts from the engine 10. The interior of the engine 10 may be lubricated and cooled by a fluid bath which is sprayed onto the rotating block 25 by a pump 26. Generally, this will be a conventional oil or fluid compound designed for this particular use. Natural drainage through drain ports 28 and finally back to the pan 29 establish a circulatory system for the engine 10 which lubricates and cools the moving parts and surfaces inside the housing 11.

It will be noted that the rotating block 25 has fins 30 at each of the corners thereof radially placed about the axis of the central power shaft 18 to aid in this cooling and lubricating process. The fins 30 splash the fluid about within the housing 11 and act as a kind of radiator for the heat built up within the rotating block 25 caused by operation of the engine 10. Of course, it is conceivable that the housing 11 could be finned so as to promote air cooling either to supplement or substitute entirely for the fluid cooling system.

Figure 2:
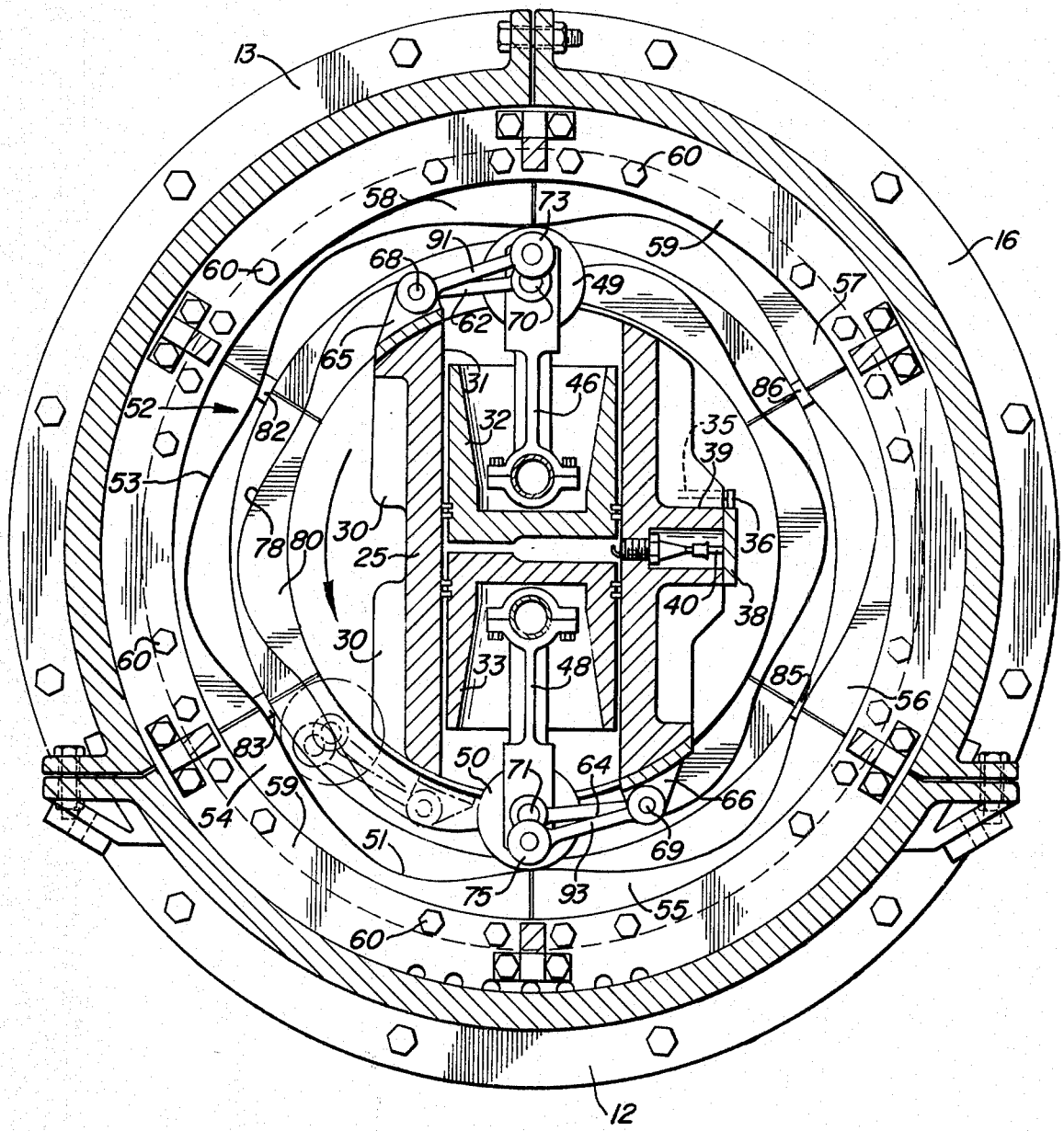
FIG. 2 is a cross sectional view taken substantially along line 2—2 of FIG. 1 of the rotary internal combustion engine showing the component make up of the housing and exterior of the engine.

The rotating block 25 has a cylinder 31 therethrough which lies perpendicular and radial to the axis A established by the central power shaft 18. Within this cylinder 31, as best seen in FIGS. 1 and 2, are two radially disposed, opposing pistons 32 and 33. It is believed that an engine embodying the concepts of the present invention could just as readily employ three, four or more pistons within the rotating block 25 which could communicate with a cylinder such as 31 or two or more cylinders. The cylinder 31 permits a single ignition of combustible gases therein to provide the driving thrust to the central power shaft 18 which greatly simplifies the problems of timing of the engine. An ignition plug 34 provides for the ignition of the gases in the cylinder 31 and is mounted in the rotating block 25 so as to communicate with the cylinder 31.

An insulated ignition conductor 35 is mounted within the intake section of power shaft 18 which may be facilitated by drilling a bore in the end of section 19, inserting the conductor 35, having any suitable shape, and plugging the point of entry. A radially extending insulated ignition conductor 36 is connected to the bar 35 and passes over the exterior of rotating block 25, insulated therefrom, to a protective cap 38 (FIG. 2) which covers the ignition plug 34 and is connected to a housing 39 carried by the block 25. An ignition wire 40 passes from the cap 38 to the plug 34, and provides a spark thereto. Another radially extending insulated ignition conductor 41 is connected to the bar 35 and is affixed to a radial disc 42 carried by the intake section of shaft 18. The circumference or disc 42 preferably carries a conductive surface such as a copper strip 43 which is in contact with a unit 44 for discharging an ignition spark such as an electronic ignition or conventional set of breaker points which is in turn supplied current by a coil 45 or alternatively, a magneto. Thus, the ingition conductors 35, 36 and 41 and the spark plug 34 rotate together with the power shaft 18 and rotating block 25 to provid a novel ignition system for the engine 10.

Connected to the pistons 32 and 33 are piston rods 46 and 48, respectively, which are pivotally connected to cycle cam followers 49 and 50, respectively. As best seen in FIG. 2 of the drawings, cycle cam followers 49 and 50 engage an inner circumferential surface 51 of a segmented cycle cam generally 52, which circumscribes the rotating block 25 and includes six individual sections 53–58, each said section being mounted on a master ring 59 by means of bolts 60. The six individual segments 53–58 of cycle cam 52, as shown in FIG. 2 of the drawings, are employed to simplify the manufacturing thereof and in the event of wear only those segments 53–58 in need of replacement need be removed. This greatly reduces the cost of major engine overhaul work since one could readily remove various sections 13–16 of housing 11 for instance as warranted to remove and replace the segments 53–58 that have become worn. It can also be readily seen that the cycle cam 52 could have any number of segments as desired. However, when six segments are employed, equalling the number of reciprocations of the pistons 32 and 33 in a single revolution of the central power shaft 18 about its axis A, all of the segments can be conveniently cast from the same mold for a considerable savings on initial manufacturing costs for this engine.

The cam followers 49 and 50 are each connected to a pair of short actuator arms 61, 62 and 63, 64, respectively, the other ends of which are pivotally connected to a corner extension, 65 and 66, respectively, of the rotating block 25, via pins 68 and 69. As depicted in FIG. 1, the actuator arms 61 and 62 are mounted on either side of the piston rod 46, and a pin 70 pivotally connects these components with the cam follower 49. Similarly, the actuator arms 63 and 64 are connected with the piston rod 48 to the cam follower 50 via pin 71.

To hold the cycle cam followers 49 and 50 in constant engagement with the inner circumferential surface 51 of cycle cam 52, and to urge the pistons 32 and 33 outwardly on the intake stroke, a pair of retention cam followers 72, 73 and 74, 75 (FIG. 4) are provided on either side of the respective cycle cam followers 49 and 50, spaced axially thereof. These retention cam followers 72–75 engage the outer circumferential surfaces 76 and 78 of retention cams 79 and 80 as best seen in FIGS. 1 and 5. The retention cams 79 and 80 may be segmented in a manner similar to the cycle cam 52 and are connected to supporting brackets, such as 81–88 (FIGS. 1 and 2), which also connect the master ring 59 and the housing 11.

The retention cam followers 72–75 are also connected to the corner extensions 65 and 66 of the rotating block 25 by paired lever arms 90–91 and 92–93, which in turn are connected to the same pivot pins 68 and 69 as the actuator arms 61–64 which connect the cycle cam followers 49 and 50 to the rotating block 25. These lever arms 90–91 and 92–93 serve to maintain a constant angular relation between the piston rods 46 and 48, at their emergence from cylinder 31, and the corners 65 and 66 of rotating block 25. This is essential to maintain all of the thrust in exact radial relation to the axis of the central power shaft 18 to insure maximum advantage as the pistons 32 and 33 are forced radially outwardly.

Figure 4:
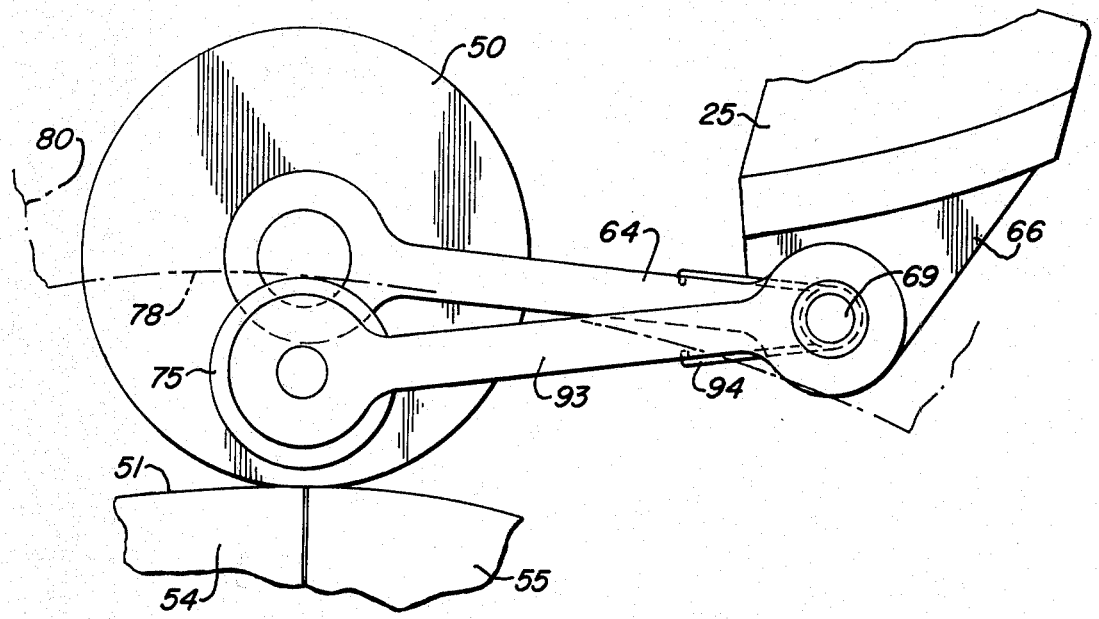
FIG. 4 is an enlarged view of the support arms as connected to the rotary block and the drive and retention cam followers for biasing the two toward constant engagement on the cam surface.
Figure 5:
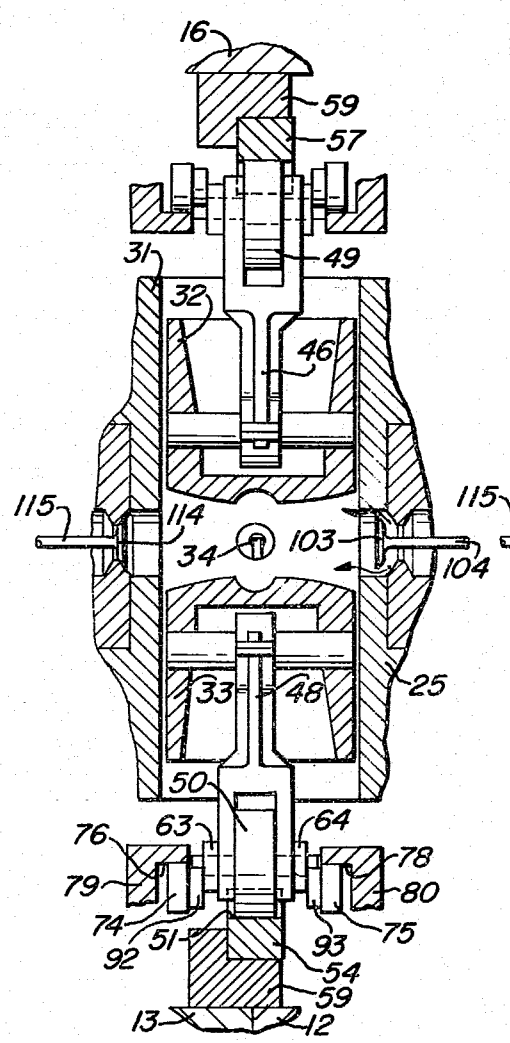

Biasing members such as the spring 94 depicted in FIG. 4, may be interposed between adjacent actuator and lever arms and held by pivot pins 68 and 69 to maintain a biasing force between actuator arms 61–62, 63–64 and lever arms 90–91 and 92–93 such that the pistons 32 and 33 will travel equal distances in the cylinder 31. This insures that the expanding gases in the cylinder 31 will force the pistons 32 and 33 equally to provide a balanced rotation to the central shaft 18. Also, as the retention cam followers 72–75 and their respective lever arms 90–93 are driven away from the rotating block 25 due to the cams 79 and 80, the springs 94 transmit this movement to the adjacent actuator arms 61–64 which in turn draw the pistons 32 and 33 out of the cylinder 31 during intake. Although the lever arms 90–93 and actuator arms 61–64 could be permanently fixed in angular relationship to each other, the spring 94 will serve to space the arms properly and at the same time will absorb any deleterious forces which could be transmitted from one arm to the other. It is recognized that numerous types of biasing members are available for use, any one of which will be satisfactory as long as this biasing force is achieved to maintain the constant engagement of the cycle cam followers 49 and 50 with the inner circumferential surface 51 of cycle cam 52.

Connected to the end of intake section 19 of the central power shaft 18, is a conventional fuel mixing system including an air cleaner 100 and carburetor 101 to obtain the proper mixture of fuel and air which is then transmitted through a manifold 102 to the interior 23 of the central power shaft intake section 19 wherein an intake valve 103 is positioned. The intake valve stem 104 is rotatably connected to an intake valve control lever 105 pivotally mounted in a fulcrum arm 106. Connected to the other end of the intake valve control lever 105 is an intake valve cam follower 108 which is urged to constant engagement with an intake valve cam 109 by a spring 110 or other conventional biasing means. The intake valve cam 109 is connected to a radially extending support 111 and keyed to the intake section 19 of central power shaft 18 for rotation therewith. This controls the actuation of intake valve 103 and thereby the input of the fuel mixture into the cylinder 31 for ignition by ignition plug 34.

The intake valve cam 109 has gear teeth 112 on a lower portion thereof which mesh with the gearing system 113 which in turn operates the pump 26 to circulate the lubricating and cooling fluid.

On the exhaust side of the central power shaft 18 is an exhaust valve 114 in the exhaust section 21 which controls the escape of the expended gases. The exhaust valve stem 115 like the intake valve stem 104 is rotatably connected to an exhaust valve control lever 116 pivotally mounted in a fulcrum arm 118. Connected to the other end of the exhaust valve control lever 116 is an exhaust valve cam follower 119 which is urged to constant engagement with an exhaust valve cam 120 by a spring 121 or other conventional biasing means. The exhaust valve cam 120 is connected to a radially extending support 122 and keyed to the exhaust section 21 of central power shaft 18 for rotation therewith. This controls the actuation of the exhaust valve 114 and thereby the escape of the expended gases from the engine 10.

A novel feature of the exhaust system of the engine 10 is the design thereof which exhausts directly from the rotating power shaft. At the end of the longitudinal bore 24 in section 21 at least one cross sectional bore 123 is located, which in communication with the bore 24, transmits exhaust gases radially out of the power shaft 18. Two angularly disposed nozzles 124 and 125 threadably engage the ends of the bore 123 to direct the exhaust gases against a plurality of cupped fins 126. The fins 126 are preferably disposed at right angles to the emission of the nozzles 124 and 125 and are immovably affixed to the inner surface 128 of an exhaust chamber 129 which surrounds the power shaft 18 and vents via exhaust pipe 130 to a conventional muffler and exhaust system. The chamber 129 may be supported by brackets such as 131 which is in turn affixed to the housing 11. Replaceable seals 132 and 133 are employed between the chamber 129 and shaft 18 and may be held in position in a suitable manner not shown. Because the exhaust gases are emitted from the angularly disposed nozzles 124 and 125, their force against one of the stationary fins 126 will tend to impart somewhat of a rotational force to the already rotating power shaft 18, thereby increasing the efficiency of the engine 10.

The engine 10 also has a flywheel 134 which is mounted on power shaft 18, either keyed or splined thereto, and is connected to a conventional means (not shown) for starting engine 10. A main drive gear 135 can also be connected to the central power shaft 18 to drive a conventional transmission 136 having a shaft 138 carrying a gear 139. A protective cover 140, or type of bell housing, encases the flywheel 134, gears 135, 139, and exhaust system components heretofore described, and may be affixed to the engine housing 11 in a suitable manner not shown.

The operation of engine 10 may now be described with particular reference to FIGS. 5–8 and 10. Bearing in mind that the cycle cam 52 has six lobes, the engine 10, which is a four-cycle design, will have three power strokes per revolution of the central power shaft 18.

Intake of fuel is depicted in FIG. 5, wherein intake valve 103 is opening, exhaust valve 114 is closed and the pistons 32 and 33 are drawn radially outwardly from each other. During this intake stroke, the pistons 32 and 33 are urged radially outwardly by virtue of the communication between retention cam followers 72–75 against the outer circumferential surfaces 76 and 78 of retention cams 79 and 80. As depicted in FIG. 2, in phantom, as the retention cam followers 72–75 rotate against retention cams 79 and 80, the lever arms 90–93 pivot around points 68 and 69 and away from the open ends of the cylinder 31. Such rotational movement is translated to the actuator arms 61–64, via biasing members 94, to withdraw the piston rods 46 and 48 and pistons 32 and 33 out of the cylinder 31, creating a reduced pressure therein for the intake of the fuel air mixture.

Figure 7:
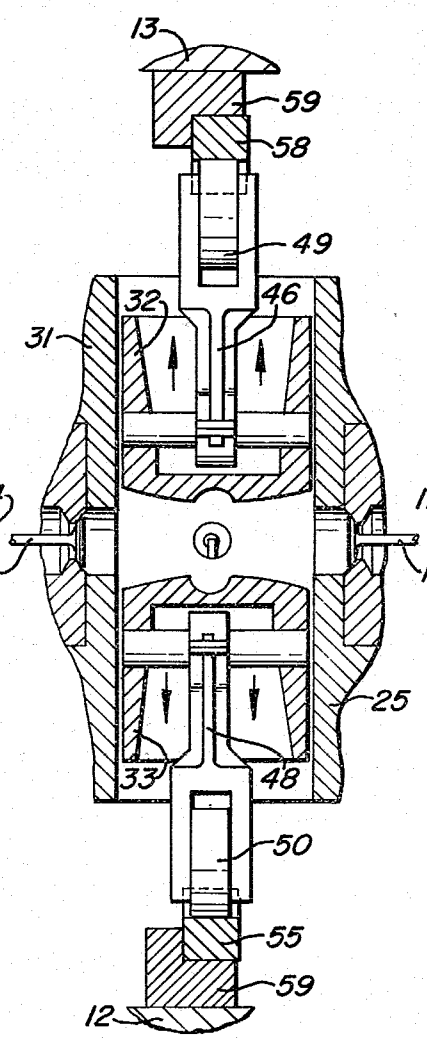
Figure 6:
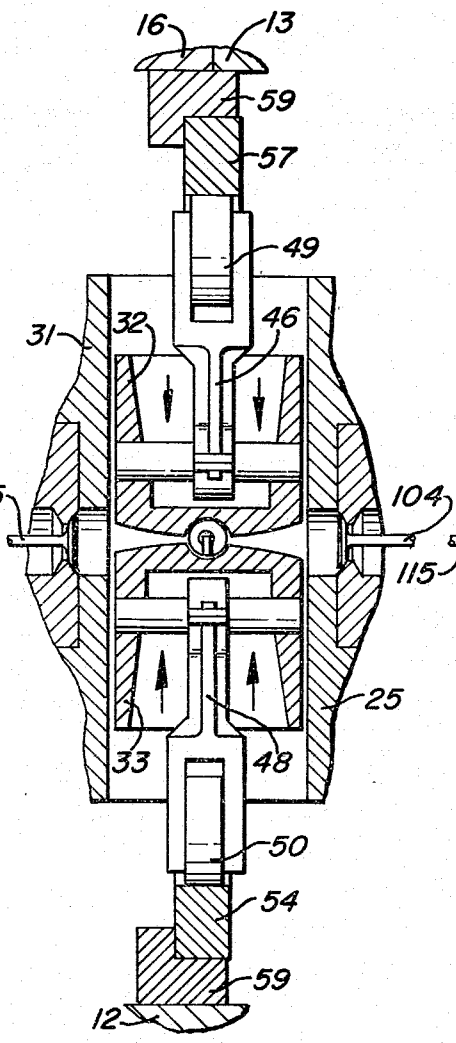

Subsequently, in FIG. 6, the pistons are urged together for compression of the fuel air mixture, by the action of cycle cam followers 49 and 50 against the convex surface of cycle cam 52. In FIG. 7, ignition has taken place and the expanding gases are utilized to drive the pistons 32 and 33 radially outwardly and away from each other. While the cam followers 49 and 50 are driven into the concave section of cycle cam 52, the thrust is transmitted, via actuator arms 61–64, against the rotating block 25 which causes it to rotate counterclockwise, as indicated by the arrow in FIG. 2.

Figure 8:
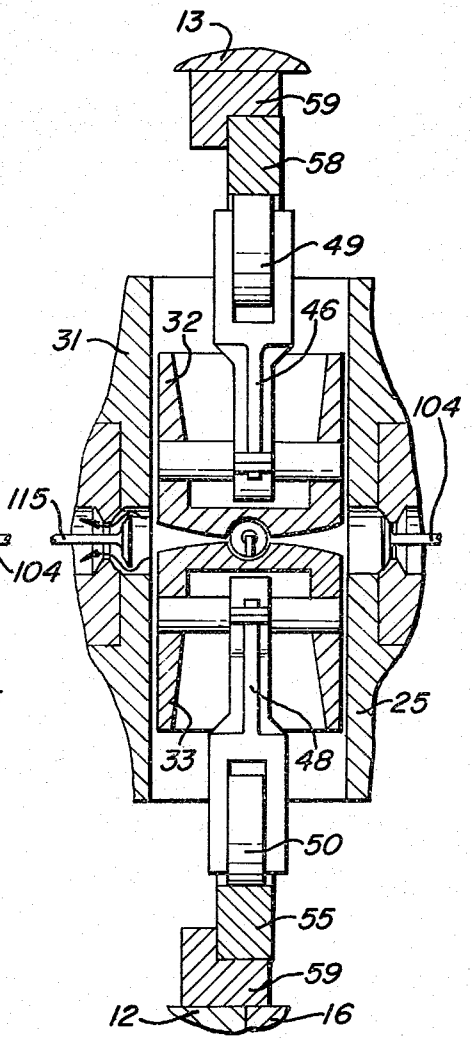
FIGS. 5–8 are partial segments of the rotary engine depicting the relation of the various moving components during intake, compression, power and exhaust.

Finally, the pistons are again driven radially inwardly and toward each other, as depicted in FIG. 8, exhaust valve 114 is opening while intake valve 103 remains closed, and the hot exhaust gases are expelled from the cylinder 31. Thereafter, the four-cycle operation is repeated while the engine is running, each piston 32, 33 being fired three times per revolution of the block 25, all four cycles occurring over two segments of the cycle cam 52. It will be noted that the slope of the cycle cam is more gradual during intake and ignition, than for compression and exhaust which therefore occur in a shorter period of time.

It is anticipated that the stroke-bore ratio of the present invention will be in the range of 0.17 which is considerably lower than a ratio of approximately 1.0 or more utilized by most in-line or V-type engines today. This will provide a higher efficiency because the per stroke usage of any given fuel will be less. Although the rpm of the engine can be readily varied, it is anticipated that a low rpm of about 400 can be used for this engine which could be run at a constant rpm with different speeds of drive accomplished through the use of a transmission. Because the power of rotation is transmitted directly to the central power shaft 18 instead of indirectly through a crank shaft of most standard engines, it is contemplated that the present invention is capable of producing comparable torque values with a significantly reduced stroke-bore ratio, and lower rpm which results in a significant fuel savings.

Figure 10A:
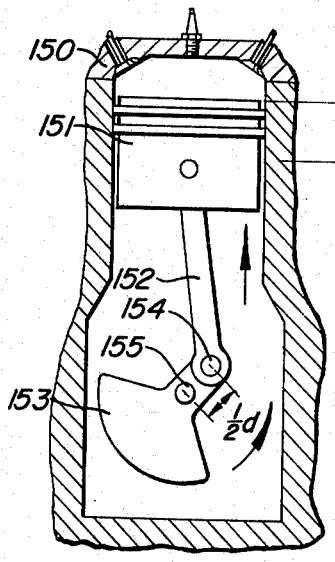
FIGS. 10A–C depict the mechanical advantage obtained with the engine of the present invention and a conventional internal combustion engine.
Figure 10B:
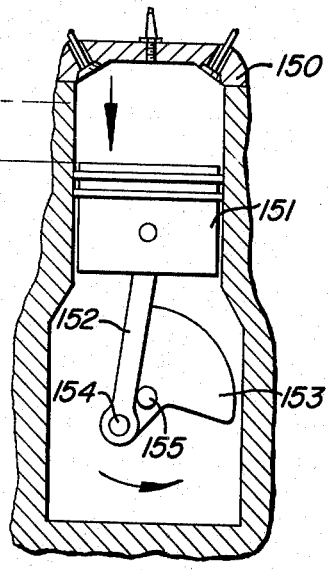

In FIG. 10A a portion of a conventional engine having a cylinder 150, piston 151, piston rod 152, and crankshaft 153 is depicted with its piston at approximately its uppermost position within the cylinder 150. In FIG. 10B the piston 151 is shown at approximately its lowermost position within the cylinder 150. The distance between the two positions, indicated by the letter *d*, is representative of the piston throw, which is actually slightly greater than depicted as the pistons have not travelled through their extreme top and bottom positions. The piston rod 152 is connected to the crankshaft 153 and has a rotational point 154. Similarly, the crankshaft itself has a rotational axis or point 155. The distance between these two points (154 – 155) is always one-half *d* in a conventional engine having a crankshaft, so that for a given piston throw *d*, the length of the crank arm ½*d*, which is related to the torque the engine should develop, is always less.

Figure 10C:
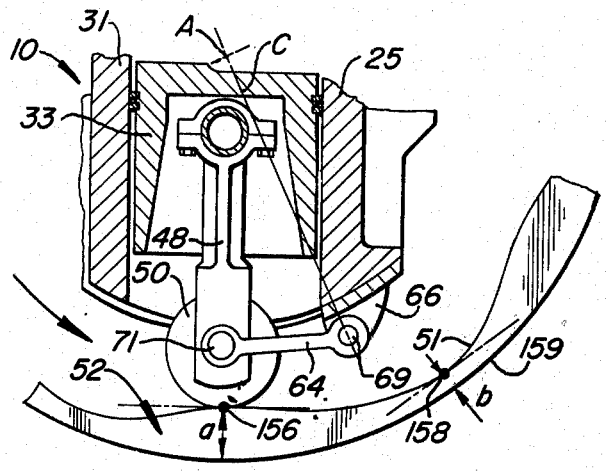
Figure 9:
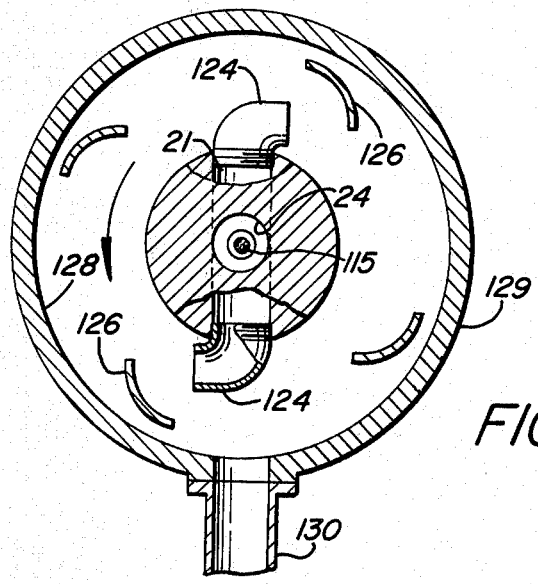
FIG. 9 is a cross sectional view, taken substantially along line 9—9 of FIG. 1 depicting a portion of the exhaust system of the present invention.

In FIG. 10C a portion of the engine 10 is depicted including the cylinder 31, a piston 33, piston rod 48, cam follower 50, cycle cam 52, and actuator rod 64. The cycle cam 52 will have a high point 156, which will determine the uppermost position of the piston 33 for compression and exhaust (FIGS. 6 and 8), and a low point 158 which determines the lowermost position of the piston 33, for the intake and power strokes (FIGS. 5 and 7). With reference to the circumference 159 of the cycle cam, the distances *a* and *b* are established as perpendiculars between points 156 and 158 to the circumference 159 and therefore, $a - b$ will equal the piston throw of the engine 10.

As explained hereinabove, the driving force of the piston 33 during its power stroke causes rotation of the block 25, and, in FIG. 10C that distance is from point 156 to point 158 on the cycle cam 52. The radially outwardly directed force of the explosion is transmitted to the block 25, imparting a rotational movement thereto, specifically to the pivot 69 on corner extension 66, via actuator arm 64. Because the block 25 is the rotating member of the engine 10, by comparing it to the crankshaft of a conventional engine, it is seen that the crank arm *c* extends from the axis of rotation A to the pivot point 69, a distance considerably greater than the piston throw. Thus, while the throw is relatively short, the torque produced is high and when it is remembered that three complete power cycles occur per revolution, it is seen that the engine 10, having but two pistons, has six power strokes per revolution on a modicum of fuel owing to the short intake stroke.

Thus, it should be apparent from the foregoing description of the preferred embodiment that the present invention herein described accomplishes the objects of the invention.

What is claimed is:

1. A rotary engine comprising:
- a housing;
- a central power shaft establishing an axis through said housing and having first and second sections, each of said sections rotatably mounted in said housing;
- a rotating block connected between said first and second sections of said central power shaft;
- at least one cylinder within said rotating block;
- at least two pistons mounted within said rotating block communicating with said cylinder such that upon ignition said pistons are urged radially outwardly from the axis of said central power shaft;
- piston rods connected to said pistons;
- means for transmitting the radially outward movement of said pistons to said rotating block thereby imparting a rotational movement thereto including;
  - a cycle cam circumscribing said rotating block;
  - cycle cam followers carried by said piston rods and engaging said cycle cam;
  - actuator arms connecting said cam followers to said rotating block;
  - at least one retention cam mounted within said housing and concentric with said power shaft;
  - a retention cam follower for each said piston;
  - a lever arm connecting said retention cam follower to said rotating block;
  - means for biasing said lever arm with respect to said actuator arm whereby said cycle cam follower is maintained against said cycle cam at all times;
- a fuel intake system;
- an exhaust system; and,
- an ignition system.

2. A rotary engine according to claim 1 wherein said cycle cam comprises a plurality of segments mounted within said housing to provide a continuous surface for said cam followers concentric with said power shaft whereby each said piston is reciprocated within said cylinder through three complete cycles per revolution of said rotating block.

3. A rotary engine according to claim 1, wherein said retention cam comprises a plurality of segments providing a continuous surface for said retention cam followers and wherein said means for biasing comprises a spring.

4. A rotary engine according to claim 1, further comprising an intake valve journaled within said first section of said central power shaft to allow the flow of fuel therethrough into said cylinder for ignition.

5. A rotary engine according to claim 4, further comprising means for controlling movement of said intake valve according to the rotation of said central power shaft.

6. A rotary engine according to claim 1, further comprising an exhaust valve journaled within said second section of said central power shaft to allow the escape of expended gases from said cylinder through said second section.

7. A rotary engine according to claim 6, further comprising means for controlling movement of said exhaust valve according to the rotation of said central power shaft.

8. A rotary engine according to claim 1, wherein said fuel intake system comprises:

an air cleaner;

a carburetor system to provide a proper fuel mixture to the engine; and, a manifold connecting said carburetor to said first section of said power shaft.

9. A rotary engine according to claim 1, wherein said second section of said power shaft has a first longitudinally extending bore and a second cross sectional bore connecting said first bore with the exterior of said power shaft and wherein said exhaust system comprises:

a nozzle connected to each end of said second bore, angularly disposed therefrom, and rotatable with said power shaft;

a cylindrical exhaust chamber non-rotatably mounted, concentrically, with respect to said power shaft and encasing said nozzles;

a plurality of cupped fins immovably affixed to the inner surface of said exhaust chamber at approximately right angles to said nozzles whereby exhaust gases emitted from said nozzles, striking said fins, assists the rotation of said power shaft; and, means for exhausting said chamber to the atmosphere.

10. A rotary engine according to claim 1, wherein said ignition system comprises:

means for generating a spark;

an ignition plug;

a housing carried by said rotating block for said plug having a removable cap in electrical contact with said plug;

a radially extending disc non-rotatably mounted on said power shaft and in electrical contact with said means for generating a spark; and, an insulated ignition conductor means carried by said power shaft and in electrical contact with said radially extending disc and said cap for transmitting a spark from said means for generating to said ignition plug.

11. A rotary engine according to claim 10, wherein said insulated ignition conductor means comprises:

a first insulated conductor bar provided within said power shaft;

a second insulated conductor bar partially embedded in said power shaft and in electrical contact with said first bar and said cap; and, a third insulated conductor bar partially embedded in said power shaft and in electrical contact with said first bar and said radially extending disc.

12. A rotary engine according to claim 1 further comprising means for circulating a fluid within said fixed block to lubricate and cool the moving parts thereof.

13. A rotary engine comprising:

a housing;

a central power shaft establishing an axis through said housing and having first and second sections, each of said sections rotatably mounted in said housing;

a rotating block connected between said first and second sections of said central power shaft;

at least one cylinder within said rotating block;

at least two pistons mounted within said rotating block communicating with said cylinder such that upon ignition said pistons are urged radially outward from the axis of said central power shaft;

piston rods connected to said pistons;

means for transmitting the radially outward movement of said pistons to said rotating block thereby imparting a rotational movement thereto;

a fuel intake system;

an exhaust system; and, an ignition system including:

means for generating a spark;

an ignition plug;

a housing carried by said rotating block for said plug having a removable cap in electrical contact with said plug;

a radially extending disc nonrotatably mounted on said power shaft and in electrical contact with said plug;

a radially extending disc nonrotatably mounted on said power shaft and in electrical contact with said means for generating a spark; and, an insulated ignition conductor means carried by said power shaft in electrical contact with said radially extending disc and said cap for transmitting a spark from said means for generating to said ignition plug.

14. A rotary engine according to claim 13, wherein said insulated ignition conductor means comprises:

a first insulated conductor bar partially embedded in said power shaft, and in electrical contact with said first bar and said cap; and, a third insulated conductor bar partially embedded in said power shaft and in electrical contact with said first bar and said radially extending disc.

* * * * *

UNITED STATES PATENT OFFICE

CERTIFICATE OF CORRECTION

PATENT NO. : 4,003,351

DATED : January 18, 1977

INVENTOR(S) : William E. Gunther

It is certified that error appears in the above-identified patent and that said Letters Patent are hereby corrected as shown below:

Column 8, line 12, "movement" should read --moment--

Column 8, line 46, "movement" should read --moment--

Column 10, line 34, "movement" should read --moment--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*